US008256076B1

(12) United States Patent
Feller

(10) Patent No.: US 8,256,076 B1
(45) Date of Patent: Sep. 4, 2012

(54) METHOD OF MAKING AN ULTRASONIC TRANSDUCER

(76) Inventor: Murray F Feller, Micanopy, FL (US)

( * ) Notice: Subject to any disclaimer, the term of this patent is extended or adjusted under 35 U.S.C. 154(b) by 0 days.

(21) Appl. No.: 13/300,564

(22) Filed: Nov. 19, 2011

(51) Int. Cl.
*H04R 17/10* (2006.01)
*B22D 11/128* (2006.01)

(52) U.S. Cl. ..... 29/25.35; 29/594; 29/841; 29/527.6; 73/273

(58) Field of Classification Search ..... 29/25.35, 29/594, 841, 445, 527.6; 310/340, 344, 348; 73/273, 278
See application file for complete search history.

(56) References Cited

U.S. PATENT DOCUMENTS

| | | | | |
|---|---|---|---|---|
| 4,611,372 | A * | 9/1986 | Enjoji et al. | 29/25.35 |
| 6,246,154 | B1 | 6/2001 | Gluszyk | |
| 6,497,667 | B1 * | 12/2002 | Miller et al. | 29/25.35 X |
| 7,554,248 | B2 | 6/2009 | Oda | |
| 2003/0089172 | A1 | 5/2003 | Kupfernagel | |

FOREIGN PATENT DOCUMENTS

| | | | | |
|---|---|---|---|---|
| JP | 58117714 | A * | 7/1983 | 29/25.35 |

* cited by examiner

*Primary Examiner* — A. Dexter Tugbang
(74) *Attorney, Agent, or Firm* — David Kiewit

(57) ABSTRACT

A leaded piezoelectric transducer element is attached to the inside of the end surface of a closed-end cylindrical container such as a plastic cup. The outside end surface of the cup is intended for exposure to a fluid. The required components to isolate and/or resonate with the piezoelectric element are added, after which a rigid encapsulant is formed in the cup to make a single solid assembly strong enough to be clamped. The end of the cup is then thinned to yield a thin, compliant, and environmentally protecting acoustic window.

9 Claims, 1 Drawing Sheet

METHOD OF MAKING AN ULTRASONIC TRANSDUCER

BACKGROUND OF THE INVENTION

This invention relates to devices for transmitting and receiving ultrasonic energy and in particular to transit-time and vortex shedding flowmeters.

BACKGROUND INFORMATION

Transducers used for propagating acoustic waves through a liquid generally have to be environmentally isolated from the liquid by some sort of acoustically transparent window. It is desirable to have the closest possible coupling between the transducer elements and the fluid in order to maximize the acoustic efficiency and precision of measurement, which suggests that windows be as thin as possible. This must be traded off against a minimum window thickness needed for environmental isolation, particularly when dealing with high operating pressures.

BRIEF SUMMARY OF THE INVENTION

In preferred embodiments of this invention a transducer element with electrical connections is attached to the inside of the window of a container that is typically an open end plastic cup. The other side of the window is exposed to the fluid environment when the transducer is in use. The required components to isolate and/or resonate with the element are added, after which the container is partially encapsulated to make a single solid assembly. The window is then preferably machined very thin to become a very compliant, yet environmentally protecting window which has very low acoustic effects. The window, now being very compliant, can easily remain attached to the element with an adhesive, such as epoxy, and can withstand the stresses of machining operation and the environmental pressures when in actual use.

One aspect of the invention is that it provides a method of making an ultrasonic transducer. At the beginning of this process one has a closed-end cylindrical member having an end portion extending between an internal end surface and an external end surface, and a piezoelectric element. The piezoelectric element is attached the internal end surface of the cylindrical member and is then encapsulated. After encapsulation the end portion of the cylindrical member is thinned by removing material from its external end surface. A final thickness of the end portion, which serves as an acoustic window, is usually no more than 0.010" and is preferably about 0.005" thick.

Those skilled in the art will recognize that the foregoing broad summary description is not intended to list all of the features and advantages of the invention. Both the underlying ideas and the specific embodiments disclosed in the following Detailed Description may serve as a basis for alternate arrangements for carrying out the purposes of the present invention and such equivalent constructions are within the spirit and scope of the invention in its broadest form. Moreover, different embodiments of the invention may provide various combinations of the recited features and advantages of the invention, and that less than all of the recited features and advantages may be provided by some embodiments.

DETAILED DESCRIPTION OF A PREFERRED EMBODIMENT

In studying this Detailed Description, the reader may be aided by noting definitions of certain words and phrases used throughout this patent document. Wherever those definitions are provided, those of ordinary skill in the art should understand that in many, if not most, instances such definitions apply both to preceding and following uses of such defined words and phrases.

Figure 1:
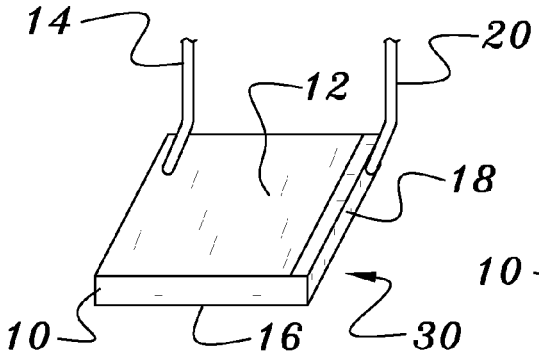
Prior Art FIG. 1
FIG. 1 is a perspective view of a leaded piezoelectric transducer having a wrap-around electrode.

FIG. 1 depicts a preferred transducer element assembly 30 comprising a piezoelectric ceramic transducer element 10 which has one connecting wire 14 attached to an electrode on its upper surface 12 and another connecting wire 20 attached to a second electrode 18 that is partially on a lower surface 16 of the transducer element and that comprises a wraparound portion 18 along an edge of the transducer element.

Figure 2:
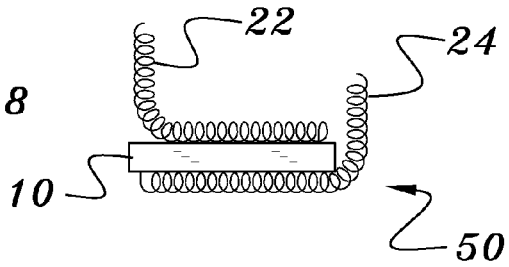
Prior Art FIG. 2
FIG. 2 is a side elevation view of a leaded piezoelectric transducer having conformal mesh leads.

FIG. 2 depicts another preferred transducer element assembly 50 that uses conformal mesh pieces 22, 24 to make contact to the upper 12 and lower 16 surfaces, respectively, of the transducer element. In this case the wraparound surface is not needed as the mesh makes direct contact with the lower surface 16.

Figure 3:
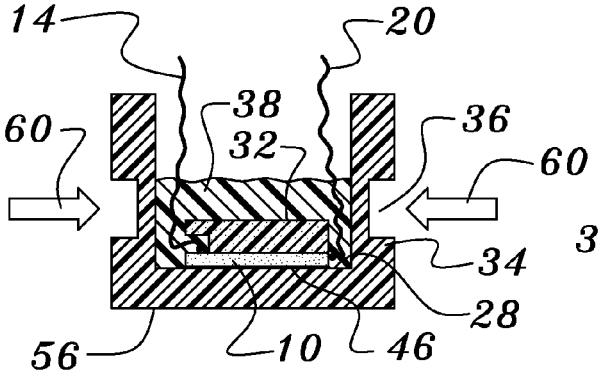
FIG. 3 is a partly schematic cross-sectional view of a partially encapsulated foam-backed piezoelectric element mounted in a cylindrical cup or pot.
Figure 5:
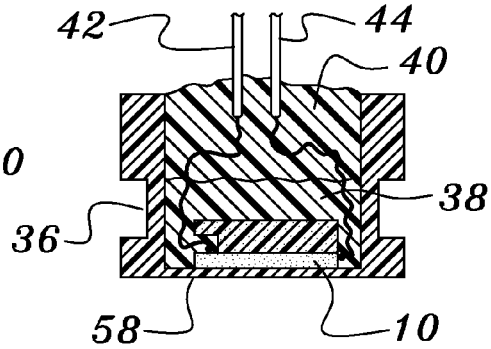
FIG. 5 is a partly schematic cross-sectional view of a transducer structure comprising the piezoelectric element of FIG. 3 and additional encapsulant, the view taken subsequent to a diaphragm-thinning process.

FIG. 3 shows a simplified cross sectional view of a partially completed transducer element assembly in a cylinder or cup 34 having a closed-end extending between an internal end surface 28 and an external end surface 56. The cup 34 or pot may be of any of a wide range of materials including metals, but preferably comprising polymeric insulators. In a particular preferred embodiment, the cup 34 was made from polysulfone, which was selected for its machinability, compatibility with epoxy adhesives and relatively good high temperature performance. Although FIG. 3 shows an O-ring groove 36 cut into the cylinder to provide environmental sealing, other environmental sealing arrangements can be selected, so this feature is optional.

Experimental transducer assemblies described herein used cups 34 machined from a polysulfone rod. Smooth, flat, and parallel internal 28 and external 56 surfaces were prepared by chucking the rod on a divider head for orbital rotation during an end milling operation to yield an end wall having a thickness of about 0.050". The reader will note that many other approaches to making a flat, smooth internal surface are known in the forming arts and include, without limitation, other machining approaches, injection molding and hot pressing.

The transducer element 10 is bonded to an internal end surface 28 of the cup 34, preferably by means of a very thin epoxy layer 46. In a particular preferred embodiment using a transducer element with a wrap-around electrode, an epoxy compounded for attaching electronic devices to heat sinks was selected and yielded a bond line believed to be less than 0.001" thick. The reader will understand that in assemblies using the mesh electrode arrangement depicted in FIG. 2 the thickness of the epoxy layer 46 may be dictated by the thickness of the mesh electrode 24.

Figure 4:
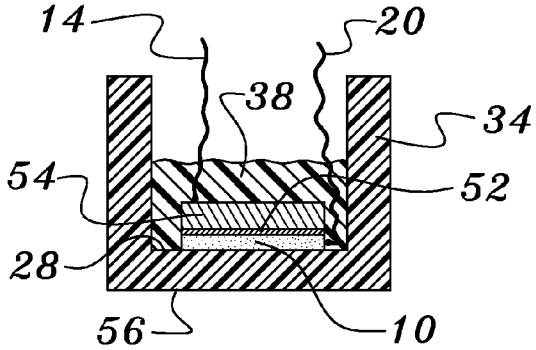
FIG. 4 is a partly schematic cross-sectional view similar to that of FIG. 3, but in which the piezoelectric element is backed with a resonator.

As known in the art, a transducer element 10 may be isolated in several ways, It may be provided by a rigid foam body 32 depicted in FIG. 3 or by the combination of an aluminum resonator strip 52 and a tungsten carbide mass 54 as depicted in FIG. 4. In an exemplar case using the structure of FIG. 3 a high density rigid urethane foam was employed with transducer elements 0.200" long X 0.125" wide X 0.020" thick. After suitable encapsulation, this device withstood operating pressures in excess of 1000 psi. In cases using the structure of FIG. 4, higher pressures can be sustained because of the greater strength of the metal resonator in comparison to the polymeric foam.

In preferred methods of assembly the transducer elements were provided with short leads and appropriate isolation elements before being attached to the internal end surface 28 of the cup 34. The reader will recognize that this is order of assembly is not essential and that others may be chosen.

After the transducer assembly is attached to the internal end surface of the cup an encapsulant 38 is used to solidify the subassembly. It may be noted that although thin piezoelectric ceramic elements of the sort used in these examples are relatively weak and easily broken during handling, encapsulating the ceramic makes the assembly substantially more sturdy. In preferred embodiments the encapsulant was selected to be a medium-hard epoxy material that bonded well to the transducer assembly and to the inside of the cup 34. A particular embodiment used type SCCE epoxy supplied by Arctic Silver Inc. Although many materials may be selected to be the encapsulant, it is important that the selected material is strong enough to allow the cup 34 to withstand being handled, e.g., clamped in a machining fixture during a subsequent window thinning step of the process.

After the encapsulant 38 is hardened, the cup 34 is preferably clamped, as indicated by the large white arrows 60 in FIG. 3, in a machining fixture and thinned by removing material from the external surface 56 of the end of the cap. In this operation most of the end of the cup is machined away to yield a window 58 having a preferred thickness in the range of 0.005" to 0.010". Windows having this range of thickness attenuate the acoustic signal very little and introduce very little in the way of reflections or other distortions. In one case, a polysulfone cup having an initial end wall thickness of 0.050 inches and an outside diameter of 0.435 inches was machined to yield a window having a thickness of 0.005 inches.

In the foregoing example the machining operation was carried out by mounting the assembly in a collet and cutting 0.045" off the end to leave a window 58 that was 0.005 inches thick. The reader will recognize that many other approaches to thinning the acoustic window 56 are known in the art and that any of these may be selected if appropriate for use with the selected cup material. Such methods include, without limitation, end milling, lathe cutting, surface grinding, electrical discharge machining, as well as chemical etching.

The use of a thin window is important. Buckling forces tend to separate the window from the element, due to mechanical stress between the window and element. These stresses occur because of factors such as the unequal thermal coefficient of expansion between the window and the element as well as moisture absorption by the window. These forces are far greater in thick windows than thin ones. This is very important because a partial or complete separation will lead to performance degradation and or complete product failure.

In the exemplar structure, after the thin window is formed external leads 42, 44 are connected to the short leads 14, 20 and additional encapsulant 40, which may be the same material as the initial encapsulant 38, is added to complete the device. The reader will understand that this sequence of steps is a matter of choice and that lead attachment and complete encapsulation could be carried out prior to the thinning operation.

Although the present invention has been described with respect to several preferred embodiments, many modifications and alterations can be made without departing from the invention. Accordingly, it is intended that all such modifications and alterations be considered as being within the spirit and scope of the invention as defined in the attached claims.

The invention claimed is:

1. A method of making an ultrasonic transducer, the method comprising the steps of:

a) providing a closed-end cylindrical member having an end portion extending between an internal end surface and an external end surface;

b) attaching a piezoelectric element assembly to the internal end surface of the cylindrical member;

c) encapsulating the piezoelectric element assembly; and then d) thinning the end portion of the cylindrical member by removing material from the external end surface thereof to yield an acoustic window.

2. The method of claim 1 wherein the internal end surface is flat and perpendicular to a side wall of the cylindrical member.

3. The method of claim 1 wherein the piezoelectric element assembly is attached to the internal end surface by a thin epoxy layer.

4. The method of claim 1 wherein the piezoelectric element assembly comprises an isolating member distal from the internal end wall.

5. The method of claim 1 wherein the encapsulating step comprises covering the piezoelectric element assembly with a medium-hard epoxy.

6. The method of claim 1 wherein the step of thinning the end portion comprises clamping the cylindrical member and removing material from the end portion thereof.

7. The method of claim 1 wherein the acoustic window is no more than 0.010" thick.

8. The method of claim 1 wherein the acoustic window is substantially 0.005" thick.

9. The method of claim 1 comprising steps after the thinning step of:

e) connecting external leads to the piezoelectric element assembly; and f) adding additional encapsulant to cover the connections so formed.

* * * * *